United States Patent [19]

Bron

[11] Patent Number: 4,643,006

[45] Date of Patent: Feb. 17, 1987

[54] LOCK HAVING AN EXTERNAL BOLT UNLOCKING DEVICE

[75] Inventor: José Bron, Amsterdam, Netherlands

[73] Assignee: Brondool, BV., Amsterdam, Netherlands

[21] Appl. No.: 826,141

[22] Filed: Feb. 4, 1986

[51] Int. Cl.[4] ..... E05B 59/00

[52] U.S. Cl. ..... 70/107; 292/33; 292/40; 292/173; 292/181

[58] Field of Search ..... 70/107; 292/173, 144, 292/181, 153, 33, 40, DIG. 62

[56] References Cited

U.S. PATENT DOCUMENTS

| | | | |
|---|---|---|---|
| 1,052,052 | 2/1913 | Gunther | 70/107 |
| 1,649,424 | 11/1927 | Tirone | 70/107 |
| 4,099,752 | 7/1976 | Geringer | 292/181 |

*Primary Examiner*—Robert L. Wolfe

*Attorney, Agent, or Firm*—Brooks Haidt Haffner & Delahunty

[57] ABSTRACT

A lock comprising a day bolt (1) and a night bolt (2), said day bolt (1) being urged by a spring (8) to an extended locking position and being retractable by a handle-operated tumbler (5) to a releasing position, said night bolt (2) urged by a spring to a retracted releasing position, and being lockable both in an extended locking position and in the retracted releasing position by a packet of tumblers (14) adapted to be swiveled by means of a suitable key to a position wherein the locking of the night bolt (2) is removed, thereby rendering it freely slidable. For swiveling the packet of tumblers there is provided a tumbler tripper (20) having an arm (21) projecting from the lock housing (4), said arm being retainable by an energized electric magnet (25) in a position wherein the tripper (20) is out of engagement with the tumblers (14) and wherein, as soon as the current supply to the electric magnet (25) is interrupted, the tripper (20) is swiveled by an associated biasing spring to a position wherein it moves the tumbler packet to the night-bolt-releasing position without interfering with the operation of the day bolt.

3 Claims, 3 Drawing Figures

LOCK HAVING AN EXTERNAL BOLT UNLOCKING DEVICE

Figure 1:
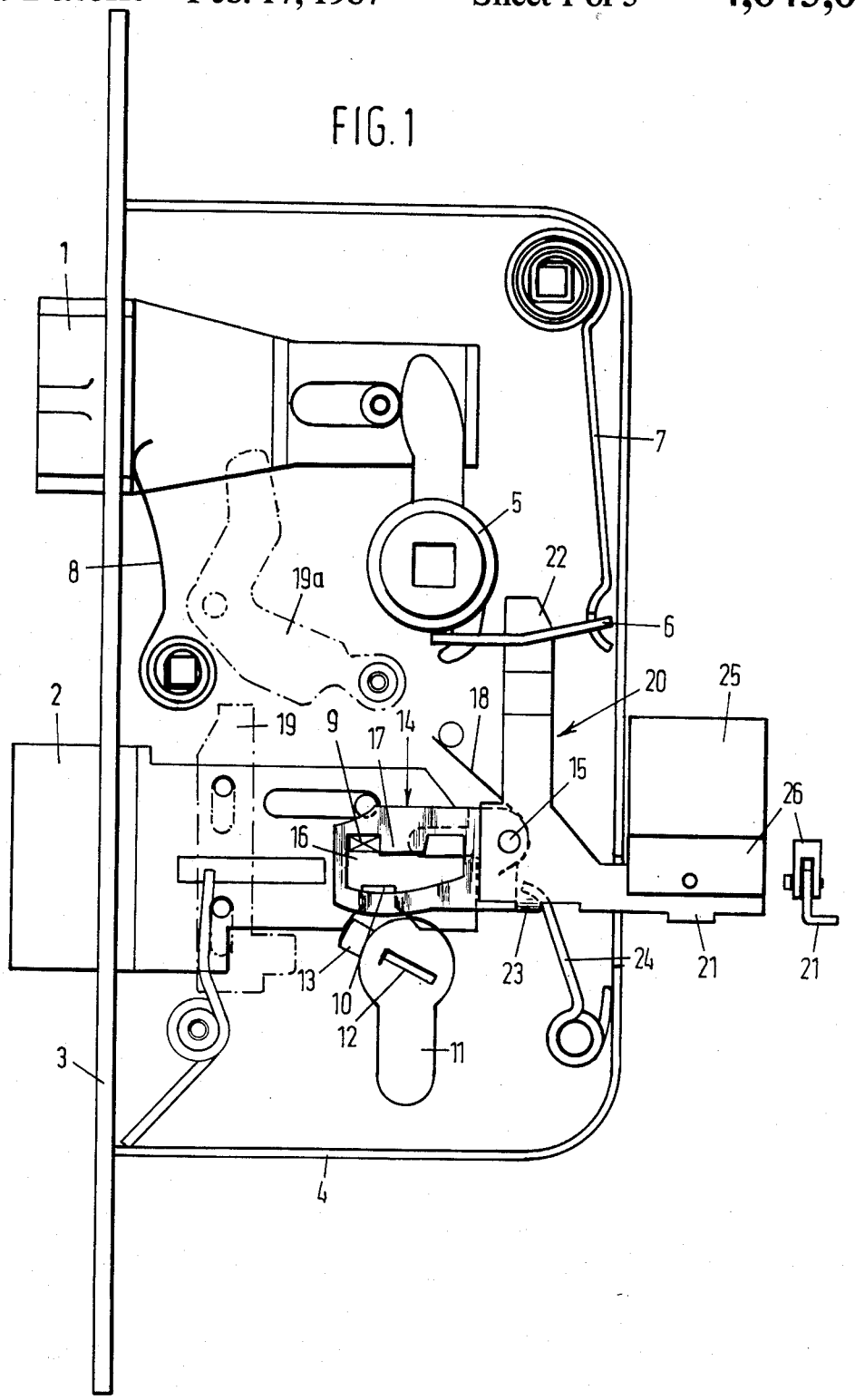

The present invention relates to a lock comprising a day bolt and a night bolt, each slidable between an extended locking position and a retracted releasing position, said day bolt being urged by a spring to the extended locking position and being retractable by a handle-operated tumbler to the releasing position, said night bolt being spring-loaded to the retracted releasing position and being lockable in both the locking and the releasing position by a locking mechanism pivotable by a key bit or by the nose of a lock cylinder against a spring biasing force to a position wherein the night bolt is slidable, and further including an actuating member for the locking mechanism operable from outside the lock.

In a similar lock disclosed in German Pat. No. 523,169, the actuating member for the locking mechanism of the night bolt is a cam movable by a rod adapted for up and down movement from a position wherein the cam does not influence the locking mechanism and a position wherein the locking mechanism is sivelled out of engagement with the night bolt so that the night bolt is pushed to the releasing position by the biasing spring. In the position wherein the locking mechanism is not influenced by the cam, the locking mechamism can be swivelled out of the night-bolt-locking position by turning an inserted key, by means of the key bit or the nose of a cylinder rotated by the key, and the night bolt is pushed to the retracted releasing position by the associated biasing spring. In the prior art lock, however, a second cam is attached to the rod of the actuating member, which cam, upon activation of the actuating member, shifts the night bolt to the retracted releasing position by means of a toggle lever against the force of a biasing spring.

Accordingly, in the prior art lock, operation of the actuating member for the locking mechanism of the night bolt results in both the night bolt and the day bolt being pushed simultaneously to the retracted releasing position.

This has the serious drawback that, in the case of fire in a building, e.g. a hotel, a nursing home or a psychiatric institution, when all doors are to be unlocked from a central point to allow easy access to all places to the fire brigade and to give confined persons an opportunity of getting out, all doors may be blown open by air movements so that the fire can propagate rapidly.

It is therefore an object of the present invention to provide a lock which does not have the above drawback while preserving the advantages of prior locks.

To this effect, according to the present invention, there is provided a lock wherein the locking mechanism is designed as a packet of tumblers through which extends a locking pin projecting laterally from the night bolt and the actuating member for the locking mechanism is a swivelling lever having one arm projecting from the lock housing and arranged to be retained by an energized electric magnet in a position wherein the lever does not operate the tumblers, said lever being loaded by a spring which tends to move it in a direction wherein the lever loads the tumblers to the night-bolt-releasing position, all this without influencing the day bolt.

The tumbler tripper according to the present invention with its electromagnetic actuation can be mounted in a simple manner in existing locks without requiring essential structural adjustments.

As long as the electric magnet is energized and the lever arm of the tumbler tripper is retained by the energized electric magnet the lock functions normally, i.e. the night bolt has to be released by key actuation and the day bolt must be actuated by a door handle or knob.

For the purpose of a central unlocking of the night bolts of all relevant locks, only the current supply to all electric magnets need be interrupted (O-current state) so that the electric magnet releases the lever arm of the tumbler tripper and this is swivelled by the associated biasing spring to the position wherein it swivels the tumblers and the night bolt is unlocked. The biasing spring presses the night bolt to the retracted releasing position, but the door remains closed in the normal manner. For opening the door, the day bolt has to be released, which is done in the normal manner by means of the door knob. It is observed that the interruption of current supply to the electric magnet of a lock can also be effected by the turning-out of a safety fuse as soon as, in the case of fire, the temperature is high enough at the location in question.

When, in any of the situations described, the tumblers have been swivelled by the tumbler tripper to the night-bolt-releasing position, then, as soon as the electric magnet has been re-energized, the tripper should be capable of being returned, against the action of the tripper-biasing spring, to the position wherein the tripper no longer influences the tumblers.

To this effect, in a further embodiment of the present invention, the lever may further be fitted with a resetting arm which, in the position wherein the tumblers have been swivelled, lies beyond reach, and in the position wherein the tumblers are not influenced by the lever, lies within reach of a member connected to the day-bolt-handle-operated tumbler in such a manner that a movement of the day-bolt handle is sufficient to return the lever to its inoperative position fixed by the electric magnet. In the lock according to the present invention, a simple movement of the day-bolt handle is thus sufficient to move the tumbler tripper to its inoperative position fixed by the electric magnet.

According to the present invention, advantageously, use can be made of the presence of a slitted strap connecting the day-bolt-handle-operated tumbler to an associated handle returning spring. The resetting arm of the lever can, in fact, project through the slit in the strap into a region wherein this is not influenced by handle movements and hence strap movements, while in the tumbler-tripping position of the lever, the arm is near the strap end distal from the day-bolt tumbler. Upon actuation of the handle, the resetting arm is taken along until the other arm of the tumbler tripper, projecting from the lock housing, comes within the reach of the electric magnet.

It is observed that German Pat. No. 223,958 discloses a lock having a day bolt and a night bolt, said night bolt being operable electromagnetically. That is not, however, a lock that can also be actuated with a normal key.

Figure 2:
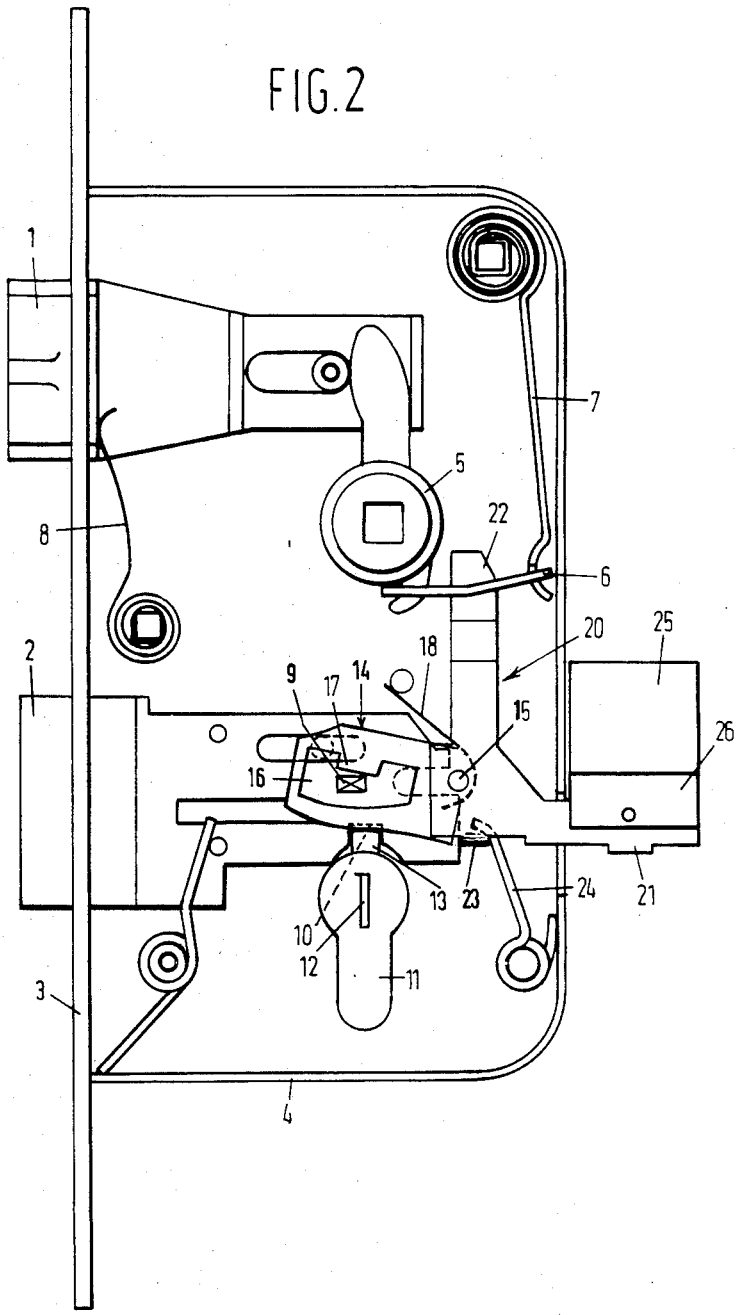
Figure 3:
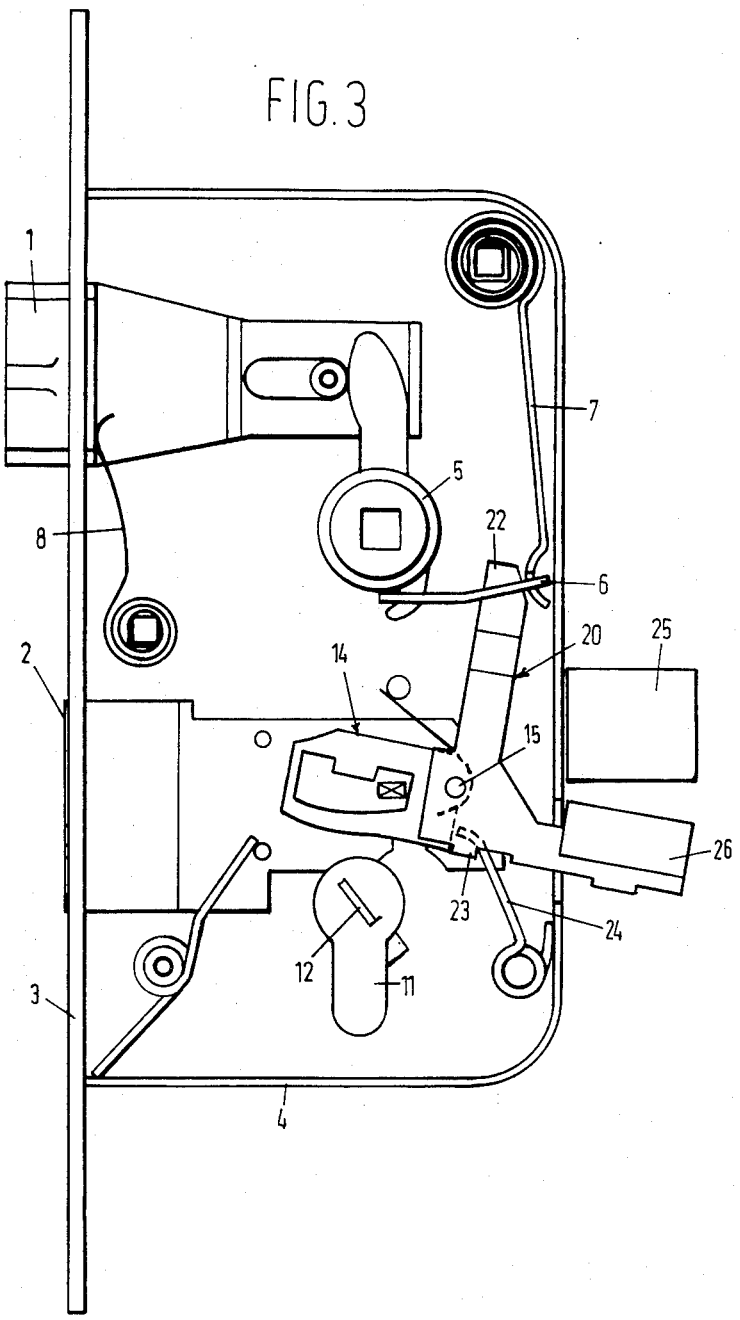

One embodiment of the lock with external bolt unlocking device will now be described, by way of example, with reference to the accompanying drawings, in which:

FIG. 1 diagrammatically shows the interior of a mortise lock;

FIG. 2 shows the lock shown in FIG. 1 during normal use, omitting parts irrelevant for the present invention; and FIG. 3 shows the lock shown in FIG. 2 with the tumbler swivelled by the tumbler tripper.

As shown in the drawings, the lock comprises a day bolt 1 and a night bolt 2, both depicted in the locking position projecting from the lock plate. The lock housing 4 contains the lock mechanism comprising a tumbler 5 for a day-bolt handle, not shown. The tumbler is connected to a return spring 7 through slitted strap 6. Acting on bolt 1 is a spring 8 loading the same to the extended locking position.

The night bolt 2 comprises a laterally projecting locking pin 9 and a recess 10. A nose 13 of a cylinder 11 with key channel 12 is adapted to move night bolt 2 to and fro by engagement in the recess 10, for which purpose, however, the noise 13 should first swivel away a packet of tumblers 14 about a common pin 15, in the manner shown in FIG. 2, so that the locking pin 9 projecting through a recess 16 into the tumbler packet 14 is released from the locked position behind a cam 17 shown in FIG. 1. Upon further clockwise rotation of the nose 10 from the position shown in FIG. 2, this is released from the tumblers, which are then swivelled back by tumbler springs 18 to the position shown in FIG. 1, wherein the locking pin 9 is again locked, but now at the other side of cam 17. The night bolt 2 is therefore locked also in the retracted, releasing position.

FIG. 1 also shows members 19, 19*a* enabling the day bolt to be released when the night bolt is in the released state, by once again turning the key clockwise. Said members are not relevant for the present invention and hence have been omitted from FIGS. 2 and 3.

One of the members which, according to the present invention are added to lock described so far which as such is well known, is a tumbler tripper 20 including a lever swivelling about the pin 15 and having arms 21, 22, with arm 21 projecting from the lock housing 4.

Arms 21, 22 of tumbler tripper 20 are situated at a level different from that of tumblers 14, so that, as shown in FIG. 2, these can swivel independently of the tumbler tripper 20. The tumbler tripper, however, is fitted with a cam 23 extending perpendicular to the plane of drawing adjacent tumblers 14, which cam 23 drags along the tumbler packet 14 upon a swivelling movement of tumbler tripper 20. This situation is shown in FIG. 3.

The swivelling movements of tumbler tripper 20 are controlled on the one hand by a spring 24, which tends to swivel the tripper 20 to the position depicted in FIG. 3, and on the other hand by an external influence or force on the arm 21, which force, in the embodiment shown, is exerted by an electric magnet 25. A slightly tiltable block 26 on arm 21 ensures maximum contact with electric magnet 25. The magnet force should be greater than the force of the spring 24 in order to maintain the tripper in the position shown in FIGS. 1 and 2, wherein it does not influence the tumblers 14. When the magnet force drops out either because the current supply is deliberately interrupted or because the circumstances at the location in question eliminate the magnet energization, spring 24 swivels tripper 20 to the position shown in FIG. 3.

In case, starting from the situation shown in FIG. 3, the tripper is to be returned to the position shown in FIGS. 1 and 2, then energization of the magnet 25 in the embodiment shown will not be sufficient, but the arm 21 has to be positively moved against the action of spring 24 towards the magnet 25. For this purpose, the other arm 22 functions as a resetting means for the tumbler tripper. Arm 22 extends through the slit of the strap 6 connecting the day-bolt-handle-operated tumbler 5 to the handle return spring 7 in such a manner that tumbler 5 can perform the movements necessary for normal handle displacements without influencing arm 22. In the position shown in FIG. 3, however, arm 22 is in the vicinity of the strap end at the side of the handle return spring 7 so that upon movement of the tumbler 5, the arm 22 is taken along by strap 6 to the position shown in FIGS. 1 and 2, wherein the tumbler tripper can be fixed by the electric magnet.

Consequently, only a single handle actuation is necessary for resetting the tripper 20 from the position shown in FIG. 3 to the position shown in FIGS. 1 and 2.

I claim:

1. A lock comprising a day bolt (1) and a night bolt (2), each slidable between an extended locking position and a retracted releasing position, said day bolt (1) being urged by a spring (8) to the extended locking position and being retractable by a handle-operated tumbler to the releasing position, said night bolt (2) being urged by a spring to the retracted releasing position and being lockable in both the locking position and the releasing position by a locking mechamisn (14) pivotable by a key bit or by the nose (10) of a lock cylinder (11) against a spring biasing force (18) to a position wherein the night bolt (2) is slidable and further including an actuating member (20) for the locking mechanism (14) operable from outside the lock, characterized in that in a lock wherein the locking mechanism is designed as a packet of tumblers (14) through which extends a locking pin (9) projecting laterally from the night bolt (2), the actuating member for the locking mechanism is a swiveling lever (20) having an arm (21) projecting from the lock housing (4), and arranged to be retained by an energized electric magnet (25) in a position in which the lever (20) does not influence the tumblers (14), said lever (20) being loaded by a spring which tends to move it in a direction wherein the lever (20) loads the tumblers to the position releasing the night bolt (2), all this without influencing the day bolt (1).

2. A lock according to claim 1, characterized in that the lever (20) further includes a resetting arm (22) which in the position in which the tumblers (14) are swivelled is beyond reach, and in the position wherein the tumblers are not influenced by the lever, is within reach of a member connected to the day-bolt-handle-operated tumbler (5), the arrangement being such that a movement of the day-bolt handle is sufficient to move the lever (20) into its inoperative position fixed by the electric magnet (25).

3. A lock according to claim 2, comprising a slitted strap (6) connecting the day-bolt-handle-operated tumbler (5) with an associated tumbler return spring (7), characterized in that the resetting arm (22) of the lever (20) projects through the strap (6) into a region wherein it is not influenced by crank movements and hence strap movements, while in the position of the lever (20) tripping the tumblers (14), the arm (22) is near the end of the strap (6) distal from the day-bolt tumbler (5).

* * * * *